US005667734A

United States Patent [19]

Ohgane

[11] Patent Number: 5,667,734

[45] Date of Patent: Sep. 16, 1997

[54] CARBURETOR WITH REGULATING VALVE LIMITING DEVICE

[75] Inventor: Shinichi Ohgane, Sibatagun, Japan

[73] Assignee: Walbro Corporation, Cass City, Mich.

[21] Appl. No.: 650,195

[22] Filed: May 20, 1996

[30] Foreign Application Priority Data

May 19, 1995 [JP] Japan ..... 7-145677

[51] Int. Cl.[6] ..... F02M 3/08

[52] U.S. Cl. ..... 261/71; 261/DIG. 38; 261/DIG. 84; 137/382

[58] Field of Search ..... 261/DIG. 84, DIG. 38, 261/71; 137/382

[56] References Cited

U.S. PATENT DOCUMENTS

| | | | |
|---|---|---|---|
| 3,618,906 | 11/1971 | Charron | 261/DIG. 84 |
| 4,283,353 | 8/1981 | Miller | 261/DIG. 84 |
| 4,336,208 | 6/1982 | Gerhardy | 261/DIG. 38 |
| 5,236,634 | 8/1993 | Hammett et al. | 261/71 |
| 5,252,261 | 10/1993 | Gerhardy | 261/71 |
| 5,322,645 | 6/1994 | Hammett et al. | 261/DIG. 84 |

*Primary Examiner*—Tim R. Miles

*Attorney, Agent, or Firm*—Barnes, Kisselle, Raisch, Choate, Whittemore & Hulbert

[57] ABSTRACT

A carburetor in which no deviation or change occurs in the adjusted position of a fuel regulating needle valve and when a cap for limiting the adjustment is mounted on the fuel regulating valve the cap cannot be intentionally broken or removed. A flow area of a fuel pasage of a carburetor body is adjusted by a needle valve received in a threaded hole in the body. Adjacent the threaded hole the carburetor body has a cylindrical cavity having a larger diameter than that of the threaded hole. A larger-diameter threaded portion is provided on the needle valve adjacent its head. A stop ring in contact with a shoulder in the cylindrical cavity is fitted on the larger-diameter threaded portion of the valve. A cup-shaped cap is fitted on the serrated head of the fuel regulating valve. An axial protrusion formed on the outer peripheral wall of the cap is engaged with an axial groove opening into the peripheral wall of the cylindrical cavity. A retaining plate having an opening through which the cap can be inserted is fixed to the outer end wall of the cylindrical cavity of the carburetor body.

5 Claims, 2 Drawing Sheets

CARBURETOR WITH REGULATING VALVE LIMITING DEVICE

FIELD OF THE INVENTION

This invention relates to carburetors and more particularly to a device for limiting the rotation of a fuel adjustment valve of a carburetor.

BACKGROUND OF THE INVENTION

In carburetors for small internal combustion engines of the type used on power saws, lawn mowers and the like, various devices have been used to limit the rotation of the fuel regulating valves to limit the extent to which the amount of fuel supplied to the engine can be increased after the regulating valve has been adjusted during manufacture of the internal combustion engine.

One device limiting adjustment of a carburetor fuel regulating valve is disclosed in Japanese patent laid-open application Publication No. 6-102093. This laid-open application discloses a lid mounted on a head of the fuel regulating valve in order to obstruct the rotation of the fuel regulating valve in the direction of increasing fuel. When the lid is mounted on the head of the fuel regulating valve, a coil spring is utilized for suppressing movement of the fuel regulating valve. However, the rotational position of the fuel regulating valve sometimes deviates from its adjusted position. That is, there is a problem in that after completion of the adjusting operation of the fuel regulating valve, the fuel regulating valve is sometimes moved back by the force of the coil spring so that the amount of fuel delivered is changed. Further, since the head of the fuel regulating valve projects from the carburetor body, if an operator breaks the lid intentionally, the fuel regulating valve can be adjusted in the direction of increasing the amount of fuel.

SUMMARY OF THE INVENTION

It is an object of the present invention to provide an adjustment limiting device for a fuel regulating valve in a carburetor in which when a lid or cap for limiting the operation is mounted on the fuel regulating valve, no deviation occurs in the adjustment position of the fuel regulating valve and the lid or cap cannot be simply broken away from the outside of the carburetor.

In a carburetor with a fuel regulating needle valve having an enlarged head and a shank threaded in the carburetor body, the limiting device has a cylindrical cavity in the carburetor body in which the valve head is received, an enlarged threaded portion on the needle valve adjacent the head, a stop ring in contact with a shoulder of the cylindrical cavity and received on the enlarged threaded portion of the valve, a cup-shaped lid or cap received on a serrated portion of the valve head, an axial protrusion on the outer peripheral wall of the lid engaged with an axial groove in the inner peripheral wall of the cylindrical cavity, and a retaining plate having an opening through which the lid can extend is connected to the outer end wall of the cylindrical cavity of the carburetor body.

The fuel regulating valve is provided with a threaded portion fitted in the carburetor body and a larger diameter threaded portion fitted in the stop ring, and further proved with serrations on the head for receiving the lid. The larger-diameter threaded portion, the stop ring and the lid are contained in the cylindrical cavity, and retained by the retaining plate which is secured to the open end wall of the cylindrical cavity. When the fuel regulating valve is adjusted to a position capable of obtaining a predetermined amount of fuel, the stop ring comes into contact with the shoulder of the cylindrical cavity. When the lid is fitted over the head of the fuel regulating valve, the fuel regulating valve is prevented from being deviated from its adjusted position by the stop ring.

The lid is integrally formed with an axial protrusion projecting outwardly from the outer peripheral wall of the lid, and the lid is fitted over the head of the fuel regulating valve while inserting the lid into the cylindrical cavity so that the protrusion passes through a slot in the open edge of the retaining plate. At this time, the protrusion of the lid is engaged with an axially extending wider groove of the cylindrical cavity.

The head and the lid of the fuel regulating valve are contained in the cylindrical cavity, and the retaining plate for covering the axial groove is secured to the open end wall of the cylindrical portion. Therefore, after the lid is mounted, the fuel regulating valve can be rotated in the tightening direction (in the direction of reducing fuel) but cannot be rotated in the untightening direction (in the direction of increasing fuel).

Since the larger-diameter threaded portion of the fuel regulating valve is fitted in a through-hole of the stop ring while making a tapped or threaded groove, no play occurs between the fuel regulating valve and the stop ring. Accordingly, the fuel regulating valve is not moved in an axial direction after the lid has been mounted.

BRIEF DESCRIPTION OF THE DRAWINGS

The construction, operation, features and advantages of this invention will be apparent from the following detailed description of the best mode, appended claims and accompanying drawings in which

DETAILED DESCRIPTION

Figure 1:
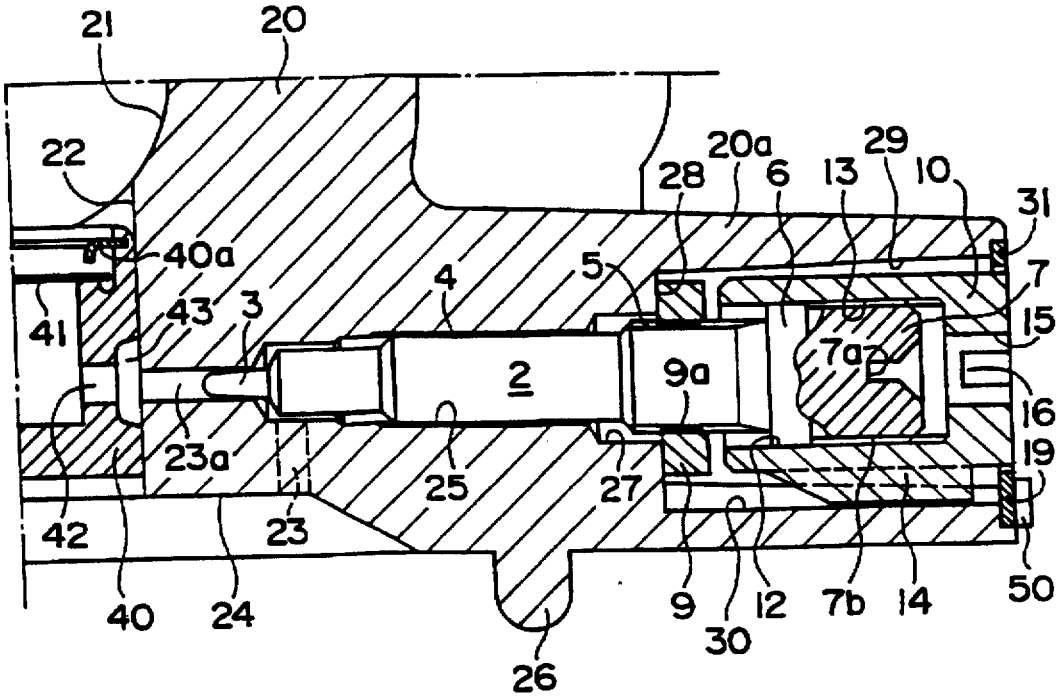
FIG. 1 is a fragmentary side sectional view showing the main parts of a carburetor provided with a limiting device of a fuel regulating valve according to the present invention.

As shown in FIG. 1, a carburetor body 20 is formed with an intake and mixing passage 21 in its central portion and extending axially in a direction perpendicular to the plane of FIG. 1 and with a fuel chamber 24 at its lower end wall. A fuel nozzle 40 is mounted in a through-hole 22 connecting the fuel chamber 24 with the intake passage 21. The fuel nozzle 40 is provided with an annular groove 43 and a diametral passage 42 on the peripheral wall of a cup-shaped body 44. A valve body 41 in the form of a known disk is disposed at the upper end of the cup-shaped body 44 and is retained by an anti-slip ring **40*a*** which is provided with a plurality of legs and fastened at the upper end of the cup-shaped body.

A fuel regulating needle valve 2 is fitted and supported in a tapped or threaded hole 25 which extends perpendicular to the through-hole 22, and has a needle portion 3 at one end which projects into a passage **23*a*. The needle valve 2 adjusts the amount of fuel supplied from the fuel chamber 24** to the intake passage 21 through passages 23, 23a, the annular groove 43 and the passage 42. A plurality of locating pins 26 are integrally formed on the lower wall surface of the carburetor body 20 and fitted into locating holes of a lower wall plate not shown. The fuel chamber 24 is defined by a diaphragm sandwiched between the carburetor body 20 and the lower wall plate. Since, the above described construction is known and since it is not directly related to the subject matter of the present invention, it is therefore not explained in further detail.

Preferably, the carburetor body 20 is provided with a sideway projecting wall portion 20a with a cylindrical portion 29 with a shoulder 28 therein, and a head 7 of the fuel regulating valve 2 and a cap or lid 10 for limiting the regulating action of the fuel regulating valve 2 are contained in a cylindrical portion 29.

The cylindrical portion 29 includes a cylindrical counterbore portion 27 having a larger diameter than that of the tapped or threaded hole 25, and a stop ring 9 described later in detail is placed in contact with a shoulder 28. The head 7 of the fuel regulating valve 2 is provided with a flange 6, serrations 7b, and at its end with a diametral groove 7a and a V-groove communicated therewith for engagement with a tool.

Figure 2:
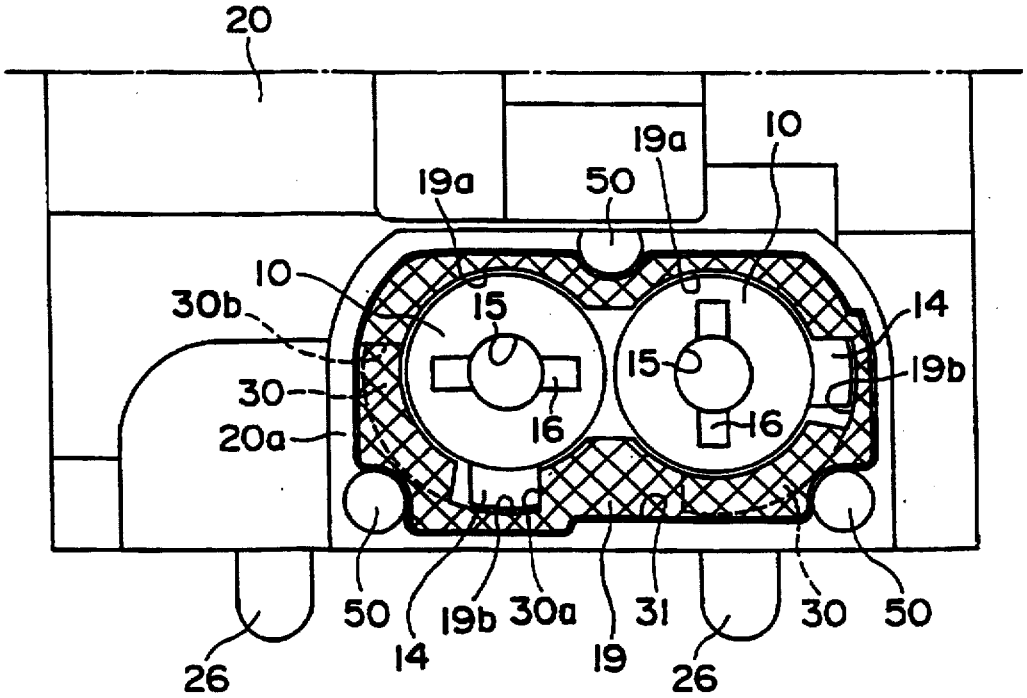
FIG. 2 is a front view showing the main parts of the carburetor provided with the limiting device.
Figure 4:
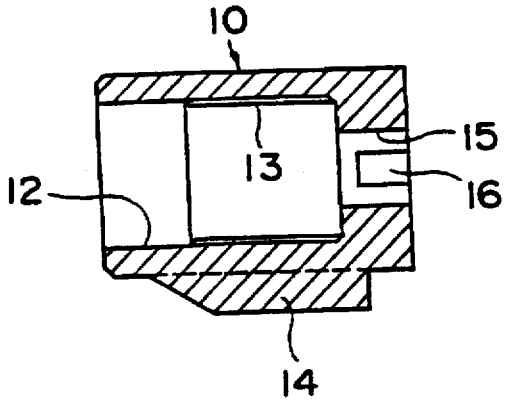
FIG. 4 is a side sectional view showing a lid of the limiting device.

A cup-shaped cap or lid 10 is provided with a cylindrical portion 12 for fitting the flange 6 therein, a serration hole 13 for fitting the serrations 7b therein, and the right end wall (FIG. 4) is formed with a circular hole 15 and a diametral groove 16 through which a tool may be inserted. The cylindrical portion 29 is formed in its inner peripheral wall with a wide axial groove 30 defined by a side wall 30a and a side wall 30b (FIG. 2). A retaining plate 19 made of metal is secured to an open end wall of the cylindrical portion 29.

Figure 3:
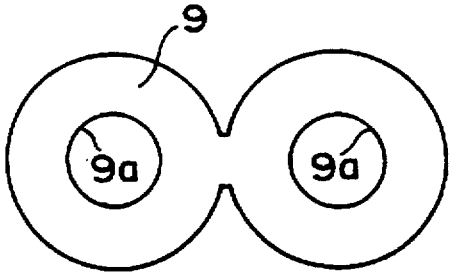
FIG. 3 is a front view showing a stop ring of the limiting device.
Figure 5:
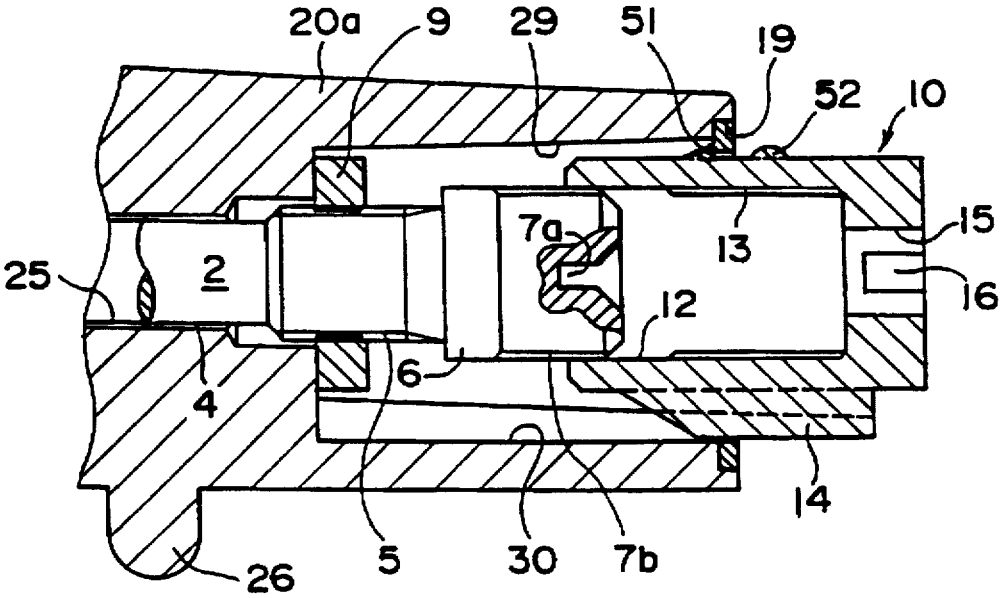
FIG. 5 is a side sectional view showing an intermediate assembly state of the limiting device.

As shown in FIG. 2 or 5, the carburetor 20 has a high-speed fuel regulating needle valve 2 and a low-speed fuel regulating needle valve 2 which are disposed parallel with each other, and the cylindrical portions 29 for containing therein the lid 10 mounted on each of the fuel regulating valves 2 causes the peripheral wall portions to be communicated with each other. Accordingly, as shown in FIG. 3, the stop ring 9 formed of soft synthetic resin is integrated or integral, and two through-holes 9a are provided therein. Each of the throughhole 9a has no tapped or threaded groove. The retaining plate 19 substantially in the form of an ellipse is provided with two circular openings 19a through which the lids 10 can be inserted, as in a lattice pattern shown in FIG. 2, with each of the openings 19a being provided with a cut 19b at the edge thereof. The width (peripheral or circumferential dimension) of the cut 19b is substantially equal to that of the protrusion 14 of the lid 10, and the retaining plate 19 partly covers the end of the groove 30 provided in the cylindrical portion 29 of the carburetor body 20. The cylindrical portion 29 is formed at its open edge with a depression or recess 31 which is the same in external shape as the retaining plate 19 and has a depth which is the same as the thickness of the retaining plate 19 so that the retaining plate 19 does not project outwardly of the wall portion 20a. Further, a plurality of outwardly projecting pillars or pins 50 are integrally formed on the end wall surface of the projecting wall portion 20a adjacent to the depression 31. After the retaining plate 19 has been fitted in the depression 31, the ends of the pins 50 are flared, mushroomed or the like and then caulked so that the retaining plate 19 is firmly fixed to the projecting wall portion 20a so that the retaining plate 19 cannot be removed. While the retaining plate 19 may be fixed in advance to the depression 31 of the open edge of the cylindrical portion 29, it is to be noted that the retaining plate 19 may be fixed after the fuel regulating valve 2 has been mounted..

The operation of the limiting device for a fuel regulating valve in a carburetor according to the present invention will now be described. A tool is placed in engagement with the groove 7a of the head 7 of the fuel regulating valve 2, the tapped portion 4 of the fuel regulating valve 2 is fitted in the threaded hole 25 of the carburetor body 20, and the larger-diameter threaded portion 5 is threaded into (cut into) the through-hole 9a of the stop ring 9 which is urged against the shoulder 28. In this condition, the amount of fuel is measured, and at the same time, the needle portion 3 is projected into the passage 23a, the area of the clearance between the passage 23a and the needle portion 3 is adjusted, and thereafter, the serration hole 13 of the lid 10 is fitted over the serrations 7b of the head 7 of the fuel regulating valve 2.

When the lid 10 is pushed into the cylindrical portion 29 from the opening 19a of the retaining plate 19, the protrusion 14 of the lid 10 is placed in engagement with the groove 30 of the cylindrical portion 29 through the cut 19b of the retaining plate 19. When the lid 10 is mounted, the fuel regulating valve 2 is not turned due to the engaging friction between the through-hole 9a of the stop ring 9 and the large-diameter threaded portion 5 of the fuel regulating valve 2. When the lid 10 is fully inserted into the cylindrical portion 29 it does not project outwardly of the projecting wall portion 20a. So, it is difficult to forcibly remove the lid 10.

When the driver or operator adjusts the amount of fuel of the carburetor, a tool is placed in engagement with the groove 6 of the lid 10 to adjust the amount of fuel. Since the protrusion 14 of the lid 10 is engaged in advance close to one side wall 30a of the groove 30, the fuel regulating valve 2 can be turned clockwise (in the direction of reducing the amount of fuel) but cannot be turned counterclockwise (in the direction of increasing the amount of fuel). With this, the amount of fuel of the carburetor cannot be adjusted to a value exceeding the maximum allowable fuel amount preset before shipping from the factory, and accordingly, engine operation that violates exhaust regulations can be prevented.

As shown in FIG. 5, preferably when the carburetor maker delivers the carburetor to the engine maker, the fuel regulating valve 2 is set in the fuel amount to a temporary value and the lid 10 is pushed by about halfway into the cylindrical portion 29 for shipment. A wedge-like or triangular anti-slip detent or protrusion 51 and a semispherical protrusion 52 are provided substantially in the central portion in an axial direction of the outer peripheral wall of the lid 10 in order to maintain this assembled state. Preferably, a plurality of anti-slip protrusions 51 and protrusions 52 as described are provided in a peripherally equally spaced relation on the outer peripheral wall of the lid 10.

At this time of delivery, the fuel regulating valve 2 is set in the predetermined amount of fuel by fitting the threaded portion 4 into the threaded hole 25 and the large-diameter portion 5 into the stop ring 9, respectively, but the lid 10 is pushed into the cylindrical portion 29 until the lid 10 comes in contact with the flange 6 of the head 7. At this time, the anti-slip protrusions 51 of the lid 10 pass through the opening 19a of the retaining plate 19, and the protrusions 52 stand-by at the outside of the retaining plate 19. The lid 10 is not pushed into the cylindrical portion 29 unless the lid 10 is strongly pushed. The engine maker rotates the fuel regulating valve 2 to finally adjust the amount of fuel, and after this, the lid 10 is fully pushed into the cylindrical portion 29.

In the intermediate assembled state shown in FIG. 5, since the wedge-like anti-slip protrusions 51 and the semispherical protrusions 52 of the lid 10 are close to the inner surface and the outer surface of the retaining plate 19, the lid 10 is neither pushed into the cylindrical portion 29 nor conversely slipped out.

Accordingly to the present invention, preferably the fuel regulating valve is provided with the threaded portion having a larger diameter than that of the threaded portion fitted in the threaded hole of the carburetor body, and the larger-diameter portion is fitted in the stop ring in contact with the shoulder of the cylindrical cavity in which the lid or cap of the carburetor body is contained. Therefore, when the lid for limiting the operation is fitted over the head of the fuel regulating valve, the position of the fuel regulating valve is not deviated or changed.

The larger-diameter threaded portion of the fuel regulating valve is fitted in the stop ring formed of synthetic resin while tapping a threaded groove, without using a spring for suppressing axial play between the fuel regulating valve and the carburetor body. Therefore, no unevenness in the tightening force for the fuel regulating valve occurs, thus obtaining the stable adjusting state. Further, since the spring for suppressing axial play between the fuel regulating valve and the carburetor body is not used, it is possible to shorten the dimension of the projecting wall of the carburetor body for mounting the fuel regulating valve.

Since the cylindrical portion for containing therein the stop ring and the lid is covered by an undetachable retaining plate, the operator of the engine cannot remove the lid intentionally.

The protrusion integral with the lid is engaged with the axial groove of the inner peripheral wall of the cylindrical cavity through the cut or slot of the retaining plate, and the protrusion is engaged so as to be adjacent to one side wall of the axial groove contiguous to the cut or slot. Therefore, the fuel regulating valve integral with the lid can be adjusted only in the direction of reducing the fuel and obstructs the adjustment in the direction of increasing the fuel, thus preventing operation of the engine which departs from the exhaust emission regulations.

In the intermediate assembled state, the wedge-like anti-slip protrusions and the semispherical protrusions of the lid are close to the inner surface and the outer surface of the retaining plate. Therefore, the lid is neither pushed into the cylindrical portion nor disengaged therefrom due to the vibrations and shocks during transportation.

What is claimed is:

1. In a carburetor for an engine which has at least one fuel regulating needle valve with a shank received in a threaded hole in the carburetor body with a needle potdon adjacent one end of the shank and a head adjacent the other end of the shank, a limiting device comprising a generally cylindrical cavity in the carburetor body having a diameter larger than that of the threaded hole in which the needle valve is received and opening to the exterior of the carburetor body, a threaded portion on the shank and adjacent the head having a larger diameter than the threaded hole in the carburetor body in which the needle valve is received, a stop ring in contact with a shoulder of the cylindrical cavity and threadably received on the larger diameter threaded portion of the needle valve, a cup-shaped cap secured with the head of the fuel regulating valve, an axial protrusion on the outer periphery of the cap, a generally axial groove in the cylindrical cavity in which the protrusion of the cap is received, and a retaining plate having an opening through which the cap can extend, said retaining plate being fixed to the carburetor body adjacent the outer end of the cylindrical cavity.

2. The limiting device according to claim 1, wherein said at least one fuel regulating valve comprises a high-speed fuel regulating valve and a low-speed fuel regulating valve which are disposed in parallel with each other, said cylindrical cavity of the carburetor body causes peripheral portions to communicate with each other, and the stop ring fitted on the larger-diameter threaded portion of each of said fuel regulating valves is formed integrally.

3. The limiting device according to claim 1, wherein the threaded portion of the valve received in the threaded hole in the carburetor body has the same pitch as that of the larger diameter threaded portion of the valve threaded in said stop ring.

4. The limiting device according to claim 1, wherein a slot through which said protrusion of said cap can pass is provided in the edge of the opening of said retaining plate, and the axial groove of said cylindrical cavity has a peripheral width which is larger than the width of the protrusion of said cap and extends in the tightening direction of the fuel regulating valve from one side wall of the axial groove corresponding with said slot.

5. The limiting device according to claim 1, wherein the retaining plate is connected to the open end wall of the cylindrical cavity of the carburetor body, the outer peripheral wall of said cap is provided with a first protrusion for retarding said cap from being disengaged and a second protrusion for retarding said cap from being inserted into the cylindrical cavity, and in the state where said cap is forced about halfway into said cylindrical cavity, said first protrusion and said second protrusion come in contact with the inner surface and the outer surface of said retaining plate, respectively.

* * * * *

UNITED STATES PATENT AND TRADEMARK OFFICE

CERTIFICATE OF CORRECTION

PATENT NO. : 5,667,734

DATED : September 16, 1997

INVENTOR(S) : Shinichi Ohgane

It is certified that error appears in the above-indentified patent and that said Letters Patent is hereby corrected as shown below:

Col. 5, Line 52, change "potdon" to "portion".

Signed and Sealed this

Second Day of December, 1997

Bruce Lehman

*Attest:*

BRUCE LEHMAN

*Attesting Officer*

*Commissioner of Patents and Trademarks*